United States Patent [19]

Wixon

[11] Patent Number: 4,790,856

[45] Date of Patent: Dec. 13, 1988

[54] SOFTENING AND ANTI-STATIC NONIONIC DETERGENT COMPOSITION WITH SULFOSUCCINAMATE DETERGENT

[75] Inventor: Harold E. Wixon, New Brunswick, N.J.

[73] Assignee: Colgate-Palmolive Company, New York, N.Y.

[21] Appl. No.: 873,486

[22] Filed: Jun. 12, 1986

Related U.S. Application Data

[63] Continuation of Ser. No. 721,866, Apr. 10, 1985, abandoned, which is a continuation-in-part of Ser. No. 661,775, Oct. 17, 1984, abandoned.

[51] Int. Cl.[4] ..... C11D 1/12; C11D 1/86; C11D 17/08; D06M 13/46

[52] U.S. Cl. ..... 8/137; 252/8.75; 252/8.8; 252/8.9; 252/173; 252/174.21; 252/545; 252/548; 252/551; 252/554; 252/555; 252/557; 252/558; 252/559; 252/DIG. 1; 252/DIG. 14

[58] Field of Search ..... 252/8.7, 8.8, 545, 557, 252/551, 554, 558; 8/137

[56] References Cited

U.S. PATENT DOCUMENTS

| | | | |
|---|---|---|---|
| 2,368,067 | 1/1945 | Lynch | 560/151 |
| 2,438,092 | 3/1948 | Lynch | 560/151 |
| 2,452,043 | 12/1945 | Flett | 260/501.12 |
| 4,140,641 | 2/1979 | Ramchandran | 252/8.7 |
| 4,154,955 | 5/1979 | Longley et al. | 252/545 |
| 4,259,216 | 3/1981 | Miyajima et al. | 252/545 |
| 4,264,457 | 4/1981 | Beeks et al. | 252/8.7 |
| 4,265,772 | 5/1981 | Jones | 252/8.8 |
| 4,268,401 | 5/1981 | Meschkat et al. | 252/8.8 |
| 4,294,710 | 10/1981 | Hardy et al. | 252/8.8 |
| 4,302,364 | 11/1981 | Gossef et al. | 252/545 |
| 4,310,683 | 1/1982 | Longley et al. | 252/545 |
| 4,321,165 | 3/1982 | Smith et al. | 252/545 |
| 4,411,803 | 10/1983 | Wixon | 252/8.8 |

OTHER PUBLICATIONS

Technical Bulletin 8000, "Astromid 18", Jun. 24, 1981, Alco Chemical Corporation.

Technical Bulletin 285E, "Monawet SNO-35", Jul. 1983, Mona Industries, Inc.

Alkaril Chemicals Product Catalogue, "Alkasurf-S-S-TA" and Alkasruf-SS-OA, p. 32.

Ashland Chemicals Bulletin, "Ethoxylated fatty amines".

Armak Product Data Bulletin, "Ethoxylated Aliphatic Ehmicals", Bulletin No. 72-13.

Chemical Abstracts, vol. 79, 1973, 68099a, p. 99.

Chemical Abstracts, vol. 78, 1973, No. 73957n, p. 101.

*Primary Examiner*—Dennis Albrecht

*Assistant Examiner*—Willie J. Thompson

*Attorney, Agent, or Firm*—M. M. Grill; N. Blumenkopf

[57] ABSTRACT

The detergency of a nonionic surfactant-cationic fabric softener/antistatic agent composition is significantly increased by the addition of a sulfosuccinamate compound such as tetrasodium N-(1,2-dicarboxyethyl) N-alkyl($C_{10}$-$C_{23}$) sulfosuccinamate of the formula

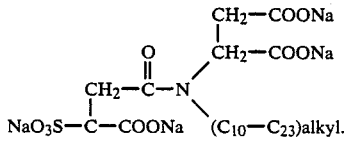

15 Claims, No Drawings

SOFTENING AND ANTI-STATIC NONIONIC DETERGENT COMPOSITION WITH SULFOSUCCINAMATE DETERGENT

This application is a continuation of application Ser. No. 721,866, filed Apr. 10, 1985, which in turn is a continuation-in-part of Ser. No. 661,775, filed Oct. 17, 1984, both abandoned.

This invention relates to a detergent-softening composition and a method for cleaning and softening fabrics in the wash cycle of a laundering operation. More specifically, the present invention relates to softening/anti-static compositions adapted for use in the wash cycle of a laundering operation, the composition including as essential ingredients a water dispersible mono-higher alkyl cationic quaternary ammonium compound softening agent, a nonionic surfactant and a sulfosuccinamate anionic detergent compound.

Compositions useful for treating fabrics to improve the softness and feel characteristics thereof are known in the art.

When used in domestic laundering, the fabric softeners are typically added to the rinse water during the rinse cycle having a duration of only from about 2 to 5 minutes. Consequently, the consumer is required to monitor the laundering operation or take other precautions so that the fabric softener is added at the proper time. This requires the consumer to return to the washing machine either just prior to or at the beginning of the rinse cycle of the washing operation which is obviously burdensome to the consumer. In addition, special precaution has to be taken to use a proper amount of the fabric softener so as to avoid over dosage which may render the clothes water repellant by depositing a greasy film on the fabric surface, as well as imparting a certain degree of yellowness to the fabrics.

As a solution to the above-noted problems, it has been known to use fabric softeners which are compatible with common laundry detergents so that the softeners can be combined with the detergents in a single package for use during the wash cycle of the laundering operation. Examples of such wash cycle added fabric softening compositions are shown in U.S. Pat. Nos. 3,351,438, 3,660,286 and 3,703,480 and many others. In general, these wash cycle fabric softening compositions contain a cationic quaternary ammonium fabric softener and additional ingredients which render the softening compounds compatible with the common laundry detergents.

It is also known, however, that the cationic softening compounds added to the wash cycle, either as an ingredient in a detergent-softener composition or as a wash cycle softener, interfere with the brightening activity, as well as the cleaning efficiency of the detergent. As a result, it has been sought to offset to some degree this interference in detergent-softening compositions by using nonionic surfactants, higher levels of brightener compound, carboxymethylcellulose, antiyellowing compounds, bluing agents, and so forth. However, little improvement has been made in wash cycle softening compositions using a variety of detergents, most of which are anionics.

There have been many disclosures in the art relating to detergent compositions containing cationic softening agents, including the quaternary ammonium compound softening agents, and nonionic surface-active compounds. As representative of this art, mention can be made of U.S. Pat. Nos. 4,264,457, 4,239,659, 4,259,217, 4,222,905, 3,951,879, 3,360,470, 3,351,483, 3,644,203, etc. In addition, U.S. Pat. Nos. 3,537,993, 3,583,912, 3,983,079, 4,203,872, and 4,264,479, specifically disclose combinations of nonionic surface-active agent, cationic fabric softener and another ionic surfactant or modifier, such as zwitterionic surfactants, amphoteric surfactants, and the like.

While many of these prior art formulations provide satisfactory cleaning and/or softening under many different conditions they still suffer from the defects of not providing adequate softening—e.g. comparable to rinse cycle—added softeners.

U.S. Pat. No. 3,920,565 discloses a liquid rinse cycle fabric softener composition containing 2 to 15% of a cationic fabric softener and 0.5 to 4.0% of an alkali metal salt of a fatty acid of from 16 to 22 carbon atoms (soap) and optionally, up to 2% of a nonionic emulsifier, the balance water. The dihigher alkyl dimethyl ammonium chlorides are the preferred cationics, although mono-higher alkyl quats are also mentioned.

It is generally accepted in the art that the mono-higher alkyl quaternary ammonium compounds, such as, for example, stearyltrimethyl ammonium chloride, being relatively water-soluble, are less effective softeners than the dihigher alkyl cationic quaternary softeners (see, for example, U.S. Pat. No. 4,326,965), and, therefore, their use in conjunction with, for example, anionic detergents, such as fatty acid soaps, with which they are capable of forming softening complexes has been suggested for use as rinse cycle fabric softeners.

The present inventor previously discovered that stable, fabric softening compositions having improved dispersibility in cold water as used in the rinse cycle, are provided by a cationic quaternary ammonium compound, as the sole softener, and an anionic sulfonate at a weight ratio of cationic to anionic of from about 80:1 to 3:1 (see U.S. Pat. No. 3,997,453). This patent discloses both mono-higher and dihigher alkyl cationic quaternary softening compounds and also discloses alkyl benzene sulfonates as the anionic compound. According to this patent, the addition of minor amounts of the anionic sulfonate to water dispersions of the excess amount of quaternary softener reduces the viscosity of the dispersion and produces a homogeneous liquid which is readily dispersible in cold water (i.e. the rinse cycle of an automatic washing machine).

As mentioned above, however, it has been recognized for some time that it would be highly desirable as a matter of convenience to employ the fabric softening formulation concurrently with the detergent in the wash cycle of the washing machine.

U.S. Pat. No. 4,222,905 to Cockrell, Jr. discloses laundry detergent compositions which may be in liquid form and which are formulated from certain nonionic surfactants and certain cationic surfactants, including mono-higher alkyl quaternary ammonium compounds, such as tallowalkyltrimethyl ammonium halide, at a nonionic:cationic weight ratio of from 5:1 to about 1:1. This patent teaches that the amount of anion-producing materials should be minimized and preferably totally avoided, but in any case, anionic materials having a dissociation constant of less than $1\times10^{-5}$, such as sodium $C_{11.8}$ linear alkylbenzene sulfonate, should be contained only in amounts up to 10%, by weight, of the cationic surfactant.

Nonionic/cationic mixed surfactant detergent compositions having a nonionic:cationic weight ratio of from about 1:1 to 40:1 in which the nonionic surfactant is of the class having a hydrophilic-lipophilic balance (HLB) of from about 5 to about 17, and the cationic surfactant is of the class of mono-higher alkyl quaternary ammonium compounds in which the higher alkyl has from about 20 to about 30 carbon atoms, are disclosed by Murphy in U.S. Pat. No. 4,239,659. This patent provides a general disclosure that other adjunct components may be included in their conventional art-established levels for use which is stated to be from about 0 to about 40%. A broad list of adjunct components is given including semi-polar nonionic, anionic, zwitterionic and ampholytic cosurfactants, builders, dyes, fillers, enzymes, bleaches, and many others. There are no examples using, and no disclosure of, anionic surfactants, however, it is stated that the cosurfactants must be compatible with the nonionic and cationic and can be any of the anionics disclosed in U.S. Pat. No. 4,259,217 to Murphy.

This latter Murphy patent discloses surfactant mixtures of nonionic surfactants having an HLB of from about 5 to amount 17 and a cationic surfactant, inclusive of monohigher alkyl quaternary ammonium compounds, at a nonionic:cationic weight ratio of from 5.1:1 to about 100:1. According to this patent, the detergent compositions may contain up to about 50%, preferably from about 1 to about 15%, of anionic surfactants and/or zwitterionic surfactants. The anionic surfactants include, among others, linear alkyl benzene sulfonates and alkyl ether sulfates. Example XV in col. 40 of this patent describes a heavy duty liquid laundry detergent composition of the following formula:

| Component | Weight % |
|---|---|
| Sodium sulfate of $C_{12-15}$ alcohol ethoxylated with 3 moles of ethylene oxide | 5.0 |
| $C_{12-13}$ alcohol ethoxylate containing an average of 6.5 moles ethylene oxide | 20.0 |
| Coconutalkyltrimethyl ammonium chloride | 3.5 |
| Glycine | 8.0 |
| Sodium toluene sulfonate | 10.0 |
| Water and minors | Balance to 100. |

The following heavy duty liquid detergent composition is shown in Example XVII (col. 41):

| Component | Weight % |
|---|---|
| Condensate of $C_{14}$–$C_{15}$ fatty alcohol with an average of 7 moles of ethylene oxide | 28.5 |
| Triethanolamine salt of linear alkylbenzene sulfonic acid wherein the alkyl chain has an average of 11.9 carbon atoms | 20.0 |
| $C_{8-18}$ alkyldihydroxyethyl methyl ammonium chloride | 1.5 |
| Ethanol | 10.0 |
| Diethylenetriamine pentamethyl phosphonic acid | 0.3 |
| Citric acid | 0.2 |
| 9.1 mixture of dimethylpolysiloxane and acrogel silica emulsified in highly ethoxylated fatty acid (commercially available from Dow Corning as DB31) | 0.3 |
| Saturated fatty acid having from 16 to 22 carbon atoms in the alkyl chain | 0.75 |
| Proteolytic enzyme | 0.4 |

-continued

| Component | Weight % |
|---|---|
| Minor adjuvants and water | Balance to 100. |

A liquid laundry detergent and fabric softener composition which contains about 3–35% by weight of a nonionic surfactant, about 3–30% by weight monohigher alkyl quaternary ammonium compound cationic surfactant and a mixture of anionic surfactants including (a) $C_4$–$C_{10}$ alcohol sulfates and (b) $C_{12}$–$C_{22}$ alcohol ethoxylated ether sulfates or carboxylates is disclosed in U.S. Pat. No. 4,264,457 to Beeks and Wysocki. The mole ratio of total cationic surfactant to total anionic surfactant can vary from 0.8:1 to 10:1. According to the patentees, the selection of and proportions of the two specific anionic surfactants to the exclusion of other known anionic surfactants is essential to obtain the maximal effectiveness for detergency, softness and anti-static properties.

The present inventor has also previously discovered that softening and anti-static performance of a detergent compound and a cationic mono-higher alkyl quaternary ammonium compound fabric softening agent is significantly enhanced by using the cationic softener as an approximately 1:1 complex with an anionic surfactant which is a linear alkyl aromatic sulfonate. This discovery is the subject matter of applicants' copending application Ser. No. 661,775, filed Oct. 17, 1984, the disclosure of which is incorporated herein by reference. Furthermore, this enhancement of the softening/anti-static performance was achieved without sacrificing, and in some cases, with significant improvement in the whitening and cleaning performance.

While excellent softening and anti-static benefits have been provided by the liquid nonionic detergent compositions based on the complex of the cationic fabric softener and linear alkyl benzene sulfonate, it is nevertheless desired to provide further improvements in the overall cleaning performance. It is also desired to be able to form the complex of the monohigher alkyl quaternary fabric softener with a broader range of commercially available anionic detergents than only the linear alkyl aromatic sulfonate anionics.

As a result of the inventor's further research, it was discovered that both of these goals could be accomplished quite readily by adding to the composition an additional surfactant compound which is a sulfosuccinamate compound. The incorporation of the sulfosuccinamate compound significantly boosts detergency of the nonionic/cationic mixture with or without the additional benefits of other anionic surfactants such as linear alkyl benzene sulfonate.

It was on the basis of these discoveries that the present invention was completed.

Accordingly, it is an object of this invention to improve softening, whitening and anti-static performance of detergent compositions containing quaternary ammonium compound softening agents and nonionic detergent compounds coupled with significant improvement in overall cleaning performance.

It is another object of this invention to formulate stable liquid detergent-softener compositions using mono-higher alkyl quaternary ammonium cationic softeners with nonionic and sulfosuccinamate surfactants as the major and essential surfactant components which compositions are compatible with fluorescent brighteners, enzymes, soil release agents, and other detergent additives.

Still another object of the invention is to provide a wash cycle laundry detergent-softener composition which can effectively clean a broad range of soils, including clays, oils, grease, etc., and impart softness to both natural and synthetic fibers and fabrics.

These and other objects of the invention which will become apparent from the following description are achieved by providing a laundry detergent composition capable of washing soiled fabrics in an aqueous wash liquid, which composition includes a nonionic surface active agent and a sulfosuccinamate surface active agent as the essential surfactants, a mono-higher alkyl quaternary ammonium compound cationic fabric softener and, optionally, an anionic surfactant. In the preferred embodiment, the detergent composition is in the form of an aqueous liquid and the composition may include at least one coloring and/or whitening agent, especially dyes, bluing agents, and optical brighteners and mixtures thereof, and other optional detergent adjuvants, especially enzymes and soil release agents.

In other useful embodiments, the composition may be formulated with only or primarily non-aqueous liquid carrier or a mixture of water and organic solvent. In still another embodiment the composition can be formulated as a paste or high viscosity liquid.

The nonionic surfactants which are contemplated can generally be any of the nonionics known to be useful as detergents for cleaning soiled fabrics.

Suitable nonionic surface active agents are commercially available and are derived from the condensation of an alkylene oxide or equivalent reactant and a reactive-hydrogen hydrophobe. The hydrophobic organic compounds may be aliphatic, aromatic or heterocyclic, although the first two classes are preferred. The preferred types of hydrophobes are higher aliphatic alcohols and alkyl phenols, although others may be used such as carboxylic acids, carboxamides, mercaptans, sulphonamides, etc. The ethylene oxide condensates with higher-alkyl phenols or higher fatty alcohols represent preferred classes of nonionic compounds. Usually, the hydrophobic moiety should contain at least about 6 carbon atoms, and preferably at least about 8 carbon atoms, and may contain as many as about 50 carbon atoms or more, a preferred range being from about 8 to 22 carbon atoms, especially from 10 to 18 carbons for the aliphatic alcohols, and 12 to 20 carbons for the higher alkyl phenols. The amount of alkylene oxide will vary considerably depending upon the hydrophobe, but as a general guide and rule, at least about 3 moles of alkylene oxide per mole of hydrophobe up to about 200 moles, preferably from about 3 to 50 moles, more preferably 5 to 20 moles of alkylene oxide per mole of hydrophobe will provide the required cleaning performance and compatibility with the other components.

Preferred classes of nonionic surfactants are represented by the formulae $$RO(CH_2CH_2O)_nH \quad (I)$$

wherein R is a primary or secondary alkyl chain of from about 8 to 22 carbon atoms and n is an average of from 5 to 50, preferably 5 to 20, especially 6 to 13; and

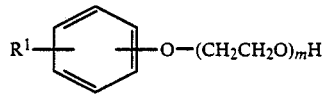

(II)

wherein $R^1$ is a primary or secondary alkyl chain of from 4 to 12 carbon atoms, and m is an average of 5 to 50, preferably 5 to 20, especially 6 to 13.

The preferred alcohols from which the compounds of formula I are prepared include lauryl, myristyl, cetyl, stearyl and oleyl and mixtures thereof. Especially preferred values of R are $C_{10}$ to $C_{18}$ with the $C_{12}$ to $C_{15}$ alkyls and mixtures thereof being especially preferred.

The preferred values of $R^1$ in formula (II) are from $C_6$ to $C_{12}$, with $C_8$ and $C_9$, including octyl, isooctyl and nonyl being especially preferred.

Typical examples of a nonionic compound of formula (I) are lauryl alcohol condensed with 5 or 7 or 11 moles ethylene oxide. Typical examples of a nonionic compound of formula II are isooctyl phenol or nonyl phenol condensed with 3 to 8 moles ethylene oxide.

Other nonionic compounds which may be used include the polyoxyalkylene esters of the organic acids such as the higher fatty acids, the rosin acids, tall oil acids, acids from petroleum oxidation products, etc. These esters will usually contain from about 10 to about 22 carbon atoms in the acid moiety and from about 3 to about 30 moles of ethylene oxide or its equivalent.

Still other nonionic surfactants are the alkylene oxide condensates with the higher fatty acid amides and amines. The fatty acid group will generally contain from about 8 to about 22 carbon atoms and this will be condensed with about 3 to about 30 moles of ethylene oxide as the preferred illustration. The corresponding carboxamides and sulphonamides may also be used as substantial equivalents.

Although ethylene oxide has been exemplified as the alkylene oxide group present in the nonionic surfactants, it is also within the scope of the invention to use nonionic surfactants formed with propylene oxide, preferably mixture of ethylene oxide and propylene oxide. For example, the nonionic surfactants sold under the well-known Plurafac series, such as Plurafac B-26, the reaction product of a higher linear alcohol and a mixture of ethylene and propylene oxides, containing a mixed chain of ethylene oxide and propylene oxide, terminated by a hydroxyl group.

In the preferred poly-lower alkoxylated higher alkanols, to obtain the best balance of hydrophilic and lipophilic moieties, the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may be contributory to gelation of the liquid detergent formulations and consequently, will preferably be omitted or limited in quantity in the present liquid compositions, although minor proportions thereof may be employed for their cleaning properties, etc, and may be desirable in the more highly viscous or paste formulations. With respect to both preferred and less preferred nonionic detergents, the alkyl groups present therein will most preferably be linear although a minor degree of slight branching may be tolerated, such as at a carbon next to or two carbons removed from the terminal carbon of the straight chain and away from the ethoxy chain, if such branched alkyl is no more than three carbons in length. Normally the proportion of carbon atoms in such a branched configuration will be minor, rarely exceeding 20% of the total carbon atom content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 50% but, as is in the case of, for example, the Tergitols, may be greater. Also when propylene oxide is present in the lower alkylene oxide chain, it will usually be less than 20% thereof and preferably less than 10% thereof, although higher percentages may also be used as in some of the Plurafacs.

The amount of the nonionic will generally be the minimum amount which when added to the wash water will provide adequate cleaning performance. Generally, amounts ranging from about 1 to about 50%, preferably from about 10 to about 40%, and especially preferably from about 12 to 35% by weight of the composition, can be used.

A second essential ingredient in the instant formulations is the cationic fabric softener. Softening agents are used to render fabrics or textiles soft, and the terms "softening" and "softener" refer to the handle, hand, touch or feel; this is the tactile impression given by fabrics or textiles to the hand or body and is of aesthetic and commercial importance. The cationic fabric softeners used in the present invention are the mono-higher alkyl quaternary ammonium compounds represented by the following formula:

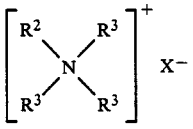

(III)

wherein $R^2$ is a long chain aliphatic radical having from 10 to 22 carbon atoms, and the three $R^3$'s are, independently, lower alkyl or hydroxy alkyl radicals and X is a water soluble salt forming anion such as halide, i.e. chloride, bromide, iodide; sulfate, citrate, acetate, hydroxide, methosulfate, ethosulfate, phosphate, or similar inorganic or organic solubilizing radical. The carbon chain of the aliphatic radical containing 10 to 22 carbon atoms, especially 12 to 20, preferably 12 to 18, and especially preferably 16 to 18 carbon atoms, may be straight or branched, and saturated or unsaturated. The lower alkyl radicals have from 1 to 4 carbon atoms, preferably 1 or 2 carbon atoms, especially preferably methyl, and may contain a hydroxyl radical. Preferably, the long carbon chains are obtained from long chain fatty acids, such as those derived from tallow and soybean oil. The terms "soya," and "tallow," etc., as used herein refer to the source from which the long chain fatty alkyl chains are derived. Mixtures of the quaternary ammonium compound fabric softeners may be used. The preferred ammonium salt is a mono-higher alkyl trimethyl ammonium chloride wherein the alkyl group is derived from tallow, hydrogenated tallow or stearic acid. Specific examples of quaternary ammonium softening agents of the formula III suitable for use in the composition of the present invention include the following: tallow trimethyl ammonium chloride, hydrogenated tallow trimethyl ammonium chloride, trimethyl stearyl ammonium chloride, triethyl stearyl ammonium chloride, trimethyl cetyl ammonium chloride, soya trimethyl ammonium chloride, stearyl dimethylethyl ammonium chloride, tallow-diisopropylmethyl ammonium chloride, the corresponding sulfate, methosulfate, ethosulfate, bromide and hydroxide salts thereof, etc.

Another useful class of commercially available quaternary ammonium fabric softener compounds are the ethoxylated compounds of formula (IV):

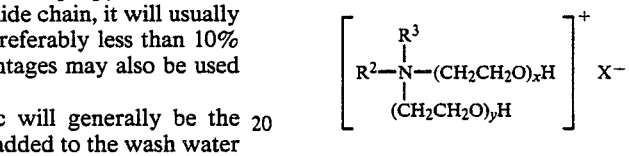

(IV)

wherein X, $R^2$ and $R^3$ are as defined for formula (III) and x and y are each positive numbers of at least 1 and the sum x+y is from 2 to 15.

An especially preferred compound of formula (IV) is sold by Armak under the trademark Ethoquad 18/12 ($R^3=CH_3$—, $R^2=C_{18}$ alkyl, x+y=2).

The amount of the monoalkyl quaternary cationic fabric softener can generally range from about 1 to about 20%, preferably from about 2 to about 16%, and especially preferably from about 2 to 10%, by weight of the composition.

The weight ratio of the nonionic surface active agent to the cationic fabric softener can be within the range of from about 1:1 to 15:1, preferably from about 1.5:1 to 10:1, especially preferably from about 2:1 to 8:1.

The sulfosuccinamate surfactant is the third essential active ingredient of the invention compositions. These compounds are characterized by having a 10 to 22 open chain hydrocarbon substituent bonded to the nitrogen atom of the carbonamide

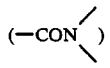

group present at one carboxy terminal end group of the succinamate moiety, and by the sulfonyl (—$SO_3$—) group bonded to one of the carbon atoms at the alpha- or beta-position with respect to the carbonamide group.

Examples of the sulfosuccinamate compound include disodium N-octadecyl sulfosuccinamate (available as Alkasurf SS-TA from Alkaril Chemicals, or as ASTROMID 18 from Alco Chemical Corp.), disodium N-oleyl sulfosuccinamate (available from Alkaril Chemicals as Alkasurf SS-OA); tetrasodium N-(1,2-dicarboxyethyl)N-octadecyl sulfosuccinamate (available as ASTROMID 22 from Alco Chemical Corp., as Monawet SNO-35 from Mona Industries, Inc. or Aerosol 22 from American Cyanamid Corp.)

More generally, however, suitable sulfosuccinamate compounds can be represented by the following general formula (V):

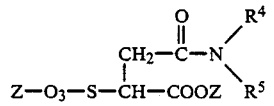

(V)

where

Z is a monovalent salt-forming cation, such as alkali metal, ammonium and amine, $R^4$ is hydrogen, lower alkyl, carboxy(lower alkyl), or 1,2-dicarboxy(lower alkyl), and $R^5$ is an open chain hydrocarbon of from 10 to 22 carbon atoms.

As the alkali metal sodium, potassium, or lithium are preferred and sodium is especially preferred.

The monovalent amine salt forming cation may be, for example, a mono-, di-, or tri-lower alkanolamine, such as mono-, di-, or triethanolamine.

The "lower alkyl" group can have from 1 to 5, preferably 1 to 3, especially preferably 1 to 2 carbon atoms.

The open chain hydrocarbon for $R^5$ may be saturated or unsaturated, and may be a straight chain or branched chain group, preferably an alkyl or alkenyl of from 14 to 18, especially 16 to 18 carbon atoms, such as, for example, tallow, hydrogenated tallow, fractionated tallow, oleyl, octadecyl, stearyl, etc.

When $R^4$ is carboxy(lower alkyl) or 1,2-dicarboxyl(-lower alkyl), such as carboxyethyl, carboxypropyl, carboxy-2-methylethyl, 1,2-dicarboxyethyl, etc., the carboxyl group or groups may be in the form —COOY where Y is the group Z or lower alkyl; preferably Y is Z, especially preferably sodium.

The amount of the sulfosuccinamate must be carefully selected depending on such factors as the nature and amount of the nonionic surfactant and cationic fabric softener, the particular sulfosuccinamate, as well as the anticipated washing conditions, including, for example, type of fabrics, soils, wash temperature, water hardness, etc. Generally, however, best cleaning performance has been achieved when the amounts of sulfosuccinamate surfactant, nonionic surfactant and monohigher alkyl cationic fabric softener are each in the following ranges—in parts by weight based on the total composition:

| | Broad | Preferred |
|---|---|---|
| (a) Nonionic Surfactant | 10–50 | 12–35 |
| (b) Monoalkyl quaternary | 1–20 | 2–16 |
| (c) Sulfosuccinamate Surfactant | 1–20 | 2–16 |

Within the above ranges the weight ratios of (a):(b), (a):(c) and (b):(c) are also important, although again, the optimum values may differ for different compounds and different washing conditions. For most cases, however, the ratios (a):(b) and (a):(c) are in the range of from about 15:1 to 1:1, preferably 10:1 to 1.5:1, especially preferably 8:1 to 2:1. The weight ratio of (b):(c) should generally be within the range of from about 3:1 to 1:3, preferably from about 2:1 to 1:2, especially preferably from about 1.3:1 to 1:2. Further, the weight ratio of (a):(b)+(c) is from about 10:1 to 1:1, preferably 6:1 to 1.5:1.

For example, in accordance with one preferred embodiment of the invention wherein the nonionic is a $C_{12}$–$C_{15}$ alcohol ethoxylated with an average of 7 moles ethylene oxide per mole of alcohol, (such as the Shell Oil Co. product Neodol 25-7) in an amount of from about 15 to 25% by weight of the total composition, the monoalkyl quaternary fabric softener is tallow trimethyl ammonium chloride, and the sulfosuccinamate is tetrasodium N-(1,2-dicarboxyethyl)-N-octadecyl sulfosuccinamate (e.g. Monawet SNO-35) the preferred ratios of the nonionic to quaternary and quaternary to the sulfosuccinamate are in the range of from about 12:1 to 4:1 and from about 1:1 to 1:2, respectively, under typical washing conditions, e.g. 120° F., 0.2% product concentration, 100 ppm hardness ions, for a broad range of fabrics and soils.

An optional, but preferred, additional component of the invention detergent composition is an anionic surfactant. Thus, as disclosed in the applicant's aforementioned copending application Ser. No. 661,775, the softening and anti-static performance of the mixture of nonionic surfactant and monohigher alkyl quaternary ammonium compound fabric softening agent is significantly enhanced by the use of a linear alkyl aromatic sulfonate detergent, preferably as a 1:1 molar complex with the quaternary fabric softener.

Examples of suitable anionic detergents include the water-soluble salts, e.g. the sodium, potassium, ammonium, alkylolammonium salts of higher linear alkyl aromatic sulfonates containing about 8 to 26 carbon atoms, preferably 10 to 22 carbon atoms, in the alkyl radical. (The term alkyl includes the alkyl portion of the higher acyl radicals.)

Preferred examples of the linear alkyl aromatic sulfonates are those containing from 10 to 16 carbon atoms in the linear alkyl radical, e.g., the sodium, potassium, and ammonium salts of higher linear alkyl benzene sulfonates, higher linear alkyl toluene sulfonates, higher linear alkyl phenol sulfonates, and higher linear alkyl naphthalene sulfonates. The linear higher alkyl benzene sulfonates such as the $C_{10}$–$C_{16}$ alkyl, especially $C_{10}$–$C_{14}$ alkyl, for example $C_{12}$ (n-dodecyl) alkyl benzene sulfonates, are especially preferred anionic surfactants.

In addition to the linear alkyl aromatic sulfonates another preferred class of anionic surfactants which can enhance the overall performance, especially anti-static and softening, of the invention detergent compositions include the alkyl ether sulfates of formula $R^6O(CH_2CH_2O)_p$-$SO_3M$, where $R^6$ is higher alkyl having from 8 to 20, especially 10 to 18, carbon atoms, M is a solubilizing salt-forming cation, such as an alkali metal ion, alkaline earth metal ion, ammonium ion, ammonium ion substituted with from 1 to 3 lower alkyls, or mono-, di- and tri-alkanolamines having 2 to 3 carbon atoms in the alkanol group or groups, and p is a number of from 2 to 8, preferably 2 to 6 (especially from 1/5 to ⅓ or ½ the number of carbon atoms in $R^6$). A preferred polyethoxylated alcohol sulfate detergent is available from Shell Chemical Company and is marketed as Neodol 25-3S. This material, the sodium salt, is normally sold as a 60% active ingredient product in an aqueous solvent medium. Although Neodol 25-3S is the sodium salt, the potassium salt and other suitable soluble salts of the triethenoxy higher alcohol (12 to 15 carbon atoms) sulfate and other such compounds herein described, such as have already been referred to and those described below, may also be used in partial or complete substitution for the sodium salts. As with the various materials of the present compositions, mixtures thereof may be utilized.

Examples of the higher alcohol polyethenoxy sulfates which may be employed as the anionic detergent constituent of the present liquid detergents or as partial substitutes for this include: mixed $C_{12-15}$ normal or primary alkyl triethenoxy sulfate, sodium salt; myristyl triethenoxy sulfate, potassium salt; n-decyl diethenoxy sulfate, diethanolamine salt; lauryl diethenoxy sulfate, ammonium salt; palmityl tetraethenoxy sulfate, sodium salt; mixed $C_{14-15}$ normal primary alkyl mixed tri- and tetraethenoxy sulfate, sodium salt; stearyl pentaethenoxy sulfate, trimethylamine salt; and mixed $C_{10-18}$ normal primary alkyl triethenoxy sulfate, potassium salt. Minor proportions of the corresponding branched chain and medially alkoxylated detergents, such as those described above but modified to have the ethoxylation at a medial carbon atom, e.g. one located four carbons from the end of the chain, may be employed and the carbon atom content of the higher alkyl will be the same. Similarly, the joinder to the normal alkyl may be at a secondary carbon one or two carbon atoms removed from the end of the chain. In either case, as previously indicated, only minor proportions should be present, such as 10 or 20%, in the usual case.

As is the case with the preferred nonionic detergents, the present poly-lower alkoxy higher alkanol sulfates are readily biodegradable and of better detergency when the fatty alkyl is terminally joined to the poly-lower oxyalkylene chain, which is terminally joined to the sulfate. Again, as in the case of the nonionic detergents, a small proportion, for example, not more than 10%, of branching, and medial joinder are tolerable. Generally, it will be preferred for the alkyl in the anionic alkoxylate detergent as in the nonionic detergent to be a mixture of different chain lengths, as 11, 12, 13, 14 and 15 carbon atoms or 12 and 13 carbon atom chains, rather than all of one chain length. Nevertheless, the invention is applicable to liquid detergents containing pure nonionic and anionic components.

Of course, ethylene oxide is the preferred lower alkylene oxide of the anionic alkoxylate detergent, as it is with the nonionic detergent, and the proportion thereof in the polyethoxylated higher alkanol sulfate is preferably 2 to 5 mols of ethylene oxide groups present per mol of anionic detergent and in more preferred compositions from 2 to 4 mols will be present, with three mols being most preferred, especially when the higher alkanol is of 12 to 13 carbon atoms or 11 or 12 to 15 carbon atoms. To maintain the desired hydrophile-lipophile balance, when the carbon atom content of the alkyl chain is in the lower portion of the 10 to 18 carbon atom range, the ethylene oxide content of the detergent may be reduced to about two mols per mol whereas when the higher alkanol is of 16 to 18 carbon atoms, in the higher part of the range, the number of ethylene oxide groups may be increased to 4 or 5 and in some cases to as high as 8 or 9. Similarly, the salt-forming cation may be altered to obtain the best solubility. It may be any suitable solubilizing metal or radical but will most frequently be alkali metal, e.g. sodium, or ammonium. If lower alkylamine or alkanolamine groups are utilized, the alkyls and alkanols will usually contain from 1 to 4 carbon atoms and the amines and alkanolamines may be mono-, di- and tri-substituted, as in monoethanolamine, diisopropanolamine and trimethylamine.

The poly-lower alkoxy higher alkanol sulfates and the linear alkyl aromatic sulfonates, are highly preferred supplementing detergents in the present compositions but other anionic detergents may be employed with them or in place of such compounds. Particularly, alpha-olefin sulfonates, paraffin sulfonates and higher alcohol sulfates may be used. The olefin sulfonate salts generally contain long chain alkenyl sulfonates or long chain hydroxyalkane sulfonates (with the OH being on the carbon atom which is not directly attached to the carbon atom bearing the $—SO_3H$ group). The olefin sulfonate detergent usually comprises a mixture of such types of compounds in varying amounts, often together with long chain disulfonates or sulfate-sulfonates. Such olefin sulfonates are described in many patents, such as U.S. Pat. Nos. 2,061,618, 3,409,637, 3,332,880, 3,420,875, 3,428,654, 3,506,580, and British Pat. No. 1,129,158. The number of carbon atoms in the olefin sulfonate is usually within the range of 10 to 25, more commonly 10 to 20, or 12 to 18, e.g. a mixture principally of $C_{12}$, $C_{14}$ and $C_{16}$, having an average of about 14 carbon atoms, or a mixture principally of $C_{14}$, $C_{16}$ and $C_{18}$, having an average of about 16 carbon atoms.

Another class of useful anionic detergents is that of the higher paraffin sulfonates. These may be primary or secondary paraffin sulfonates made by reacting long chain alpha-olefins and bisulfites, e.g. sodium bisulfite, or paraffin sulfonates having the sulfonate groups distributed along the paraffin chain, such as the products made by reacting a long chain paraffin with sulfur dioxide and oxygen under ultraviolet light, followed by neutralization with sodium hydroxide or other suitable base (as in U.S. Pat. Nos. 2,503,280, 2,507,088, 3,260,741, 3,372,188, and German Pat. No. 735,096). The paraffin sulfonates preferably contain from 13 to 17 carbon atoms and will normally be the monosulfonate but if desired, may be di-, tri- or higher sulfonates. Typically, the di- and poly-sulfonates will be employed in admixture with a corresponding monosulfate, for example, as a mixture of mono- and disulfonates containing up to about 30% of the disulfonate. The hydrocarbon substituent thereof will preferably be linear but if desired, branched chain paraffin sulfonates can be employed, although they are not as good with respect to biodegradability. The paraffin sulfonate may be terminally sulfonated or the sulfonate substituent may be joined to the 2-carbon or other carbon atom of the chain and similarly, any di- or higher sulfonate employed may have the sulfonate groups distributed over different carbons of the hydrocarbon chain.

The paraffin sulfonates and olefin sulfonates are used in the form of their alkali metal, e.g. sodium and potassium, ammonium, or mono-, di-, and tri-loweralkanolamine salts, or mixtures thereof. Triethanolamine is the preferred alkanolamine salt forming cation. The linear alkylbenzene sulfonates and alkyl ether sulfates are especially preferred as the anionic surfactant.

These anionic surfactants can not only interact with the monohigher alkyl quaternary compound to improve softening and anti-static performance but also function to cause various additional optional detergent adjuvants, as described in detail more fully below, especially optical brighteners, to deposit more effectively on the fabrics being laundered.

Although no specific rules can be applied for every combination of ingredients and for all washing conditions, it has been observed as a general rule that as between the two preferred classes of anionic surfactants, the linear alkyl benzene sulfonates are usually slightly more effective than the alkyl ether sulfates in terms of softening performance but slightly inferior in terms of cleaning performance-although the addition of any anionic surfactant often provides only slight improvements in cleaning performance as compared to the same composition without anionic surfactant. Naturally mixtures of two or more of the anionic surfactants can be used.

Since the anionic surfactant presumably forms a complex with the cationic softener to provide the enhanced softening/antistatic performance without interfering with, or slightly improving, the cleaning performance of the nonionic or with the brightener, in the detergent formula, the ratio of cationic to anionic is particularly critical since large excesses of either component could interfere with overall performance. Accordingly, ratios of cationic to anionic of from about 1.3:1 to 1:1.5, preferably 1.2:1 to 1:1.2, especially preferably 1.1:1 to 1:1.1 and most preferably about 1:1 will provide improved softening performance and anti-static performance, as well as improved whitening and perhaps cleaning.

The total amount of the cationic/anionic softener mixture in the composition generally will range from about 2 to 20%, preferably 5 to 15%, by weight based on the total composition. Moreover, the total amount of cationic softener and anionic surfactant will generally be in the range of from about 20 to 100%, preferably 30 to 80%, by weight, based on the nonionic surfactant. Furthermore, within the above amounts and ratios, the cationic/anionic softener mixture will be compatible with the nonionic surfactant, sulfosuccinamate and the optical brightener, etc.

The liquid carrier for the instant liquid detergent composition is preferably an aqueous one, and may be water alone or may be substantially water with additional solvents added for solubilizing particular ingredients, as is well known in the art. Because of the availability of water and its minimum cost, it is preferred to use water as the major solvent present. Yet, amounts of other solvents, generally up to 20%, and preferably a maximum of 15% of the total content, may be used. Generally, such a supplementing solvent will be either a lower alkanol or a lower diol or polyol, e.g. ethanol, isopropanol, ethylene glycol, propylene glycol, glycerol, or the like. Etheric polyols such as diethylene glycol and those known as cellosolves may also be used.

In addition to the supplemental solvent, it is also generally preferred to include a hydrotropic material in the formulation to maximize the compatibility of all of the active ingredients and to make the liquid formulation more homogeneous and stable. Examples of suitable hydrotropes include the alkali metal aryl sulfonates, such as sodium benzene sulfonate, sodium toluene sulfonate, sodium xylene sulfonate, and the corresponding potassium salts. The hydrotrope can be used in amounts up to about 15%, preferably up to 10% by weight of the total composition, for example, 1 to 8%, or 2 to 6%. Although the aqueous carriers are preferred, non-aqueous liquid carriers, such as the organic cosolvents mentioned above, may be used as the sole or major liquid carrier, i.e. the non-aqueous liquid carriers may comprise from about 50 to 100% by weight of the liquid carrier, the balance, if any, constituting water and/or hydrotropic material, Mixtures of two or more organic solvents may also be used.

Still further, it is possible to formulate the detergent compositions comprised of the three essential ingredients: nonionic surfactant, monohigheralkyl quaternary ammonium compound, and sulfosuccinamate detergent, plus optional anionic surfactant, and any detergent adjuvants, in the form of highly viscous compositions, such as gels, pastes, etc., by, for example, using well known and conventional thickening agents with the liquid carrier. Examples of suitable thickening agents include, for example, the cellulose ethers, such as hydroxyethyl cellulose, hydroxymethyl cellulose, methylhydroxyethylcellulose, hydroxypropyl cellulose, etc., xanthan gum, clay minerals, etc. Alternatively, the compositions may also be prepared directly as pastes, or as high viscosity liquids by simply mixing the various ingredients in the absence of a liquid carrier, or in the presence of only minor amounts, for example, up to about 20% by weight of liquid carrier, preferably water or water/organic solvent mixture.

Water for formulating the present liquid or paste detergents may come from the starting materials themselves, such as solutions or suspensions of the various detergent salts, or may be added. When added, it will be preferable to utilize deionized water or water of low hardness, e.g., under 50 ppm of hardness salts, as calcium carbonate, preferably under 10 ppm $CaCO_3$. However, while it is undesirable to utilize hard waters, this may be done and satisfactory products may be made from waters of hardnesses as high as 200 ppm, but generally the use of such water is avoided where possible.

Various selected compatible adjuvants may also be present in the detergent composition to give it additional desired properties, either of functional or aesthetic nature. Thus, there may be included in the formulation: enzymes, e.g. proteases, amylases, lipases, etc., and mixtures thereof; bleaching agents; bleach activators and stabilizers; soil-suspending or anti-redeposition agents, e.g. polyvinyl alcohol, sodium carboxymethyl cellulose, hydroxypropyl methyl cellulose; soil release agents, e.g. Polymer QCJ from Alkaril Chemical for motor oil release, etc; dyes, bluing agents, pigments, optical brighteners, e.g., cotton, amide and polyester brighteners; bactericides, e.g. hexachlorophene; preservatives, e.g. methyl parasept or sodium benzoate; ultraviolet absorbers; pH modifying agents, e.g. amines, pH buffers; opacifying agents, e.g. behenic acid, polystyrene suspensions, etc; and perfumes. The adjuvants, of course, will be chosen to be compatible with the main constituents of the detergent formulation.

Of the adjuvants mentioned perhaps the most important for functional effect are the optical brighteners because the modern housewife has come to expect that washed clothing will no longer merely be clean and white but will also be bright in appearance. The optical brighteners are substantive to textiles being washed (such substantivity may be selective) and sometimes are of comparatively low solubilities. Accordingly, it is important that they be maintained in solution in the liquid detergent composition and, even more important, they must be immediately dispersed in the washed water so as to avoid producing a wash containing noticeable brightened spots, rather than a uniformly bright appearance. Here, the choice of brightener to obtain best results will be ascertainable to one of skill in the art. It has been found that relatively small quantities of brighteners should be used, so as not to exceed the limits of solubilities. Also, within the class of these materials certain brighteners have been found to be especially readily dissolved, and thus are suitable for incorporation in these products. Fortunately, such preferred brighteners include both cotton and amide-polyester-brighteners, making them suitable for use with laundries containing a variety of material and synthetic materials. Among the commercial brighteners that are used in the present system are Tinopal UNPA, Tinopal CBS, Tinopal 5BM (Ciba-Greigy), Arctic White CC, Artic White CWD (Hilton Davis), and the following Phorwhites from Verona: BHC, BKL, BUP, BBH solution BRV solution, DCR liquid, DCBVF, EV liquid, DBS liquids and ANR.

Other types of optical brighteners which give superior whitening effects are those components having no sulfonate moieties. The preferred class of brighteners for use in the pesent invention include the 2-(4-styrylphenyl)-2H-naphthol[1,2-d]triazoles, 4,4'-bis(1,2,3-triazol-2-yl)stilbenes, 4,4'-bis(styryl)bisphenyls, and the y-aminocoumarins. Specific examples of these brighteners include 4-methyl-7-diethylamino coumarin, 1,2-bis(-benzimidazol-2-yl)ethylene, and the 1,3-diphenylphrazolines, as well as 2,5-bis(benzoxazol-2-yl)thiophene, 2-styryl-naphth[1,2-d]oxazole, and 2-(stilben-4-yl)-2H-naphtho[1,2-d]triazole.

The optical brightener content of the liquid composition will normally be from about 0.2% to about 3.0%, and preferably from 0.25 to 2.7%. Such concentrations are soluble in the described liquid detergents and are effective in noticeably brightening the washed clothing. As mentioned above, the presence of the anionic surfactant can enhance the uniform deposition of the optical brightener.

Still another class of optional adjuvant are the organic detergent builders, other than the nitrilotriacetates, and sequestering agents. Representative of the class of detergent builders and sequestering or chelating agents, are sodium citrate, potassium gluconate, polyacrylic acids, ethylene diamine tetraacetic acid and the alkali metal, alkaline earth metal, amine, alkanolamine and ammonium salts thereof, etc. It is generally preferred, and is often necessary, to completely avoid the inorganic builders, especially the phosphate builders. However, where not prohibited in view of environmental conditions minor amounts of the inorganic phosphate builders can be included in the compositions.

The contents of the other adjuvants is preferably maintained at less than 5%, preferably less than 3%, by weight of the product. Use of more than the described proportions of the such compounds can often significantly change the properties, e.g. stability, of the liquid detergent, and threfore should be avoided.

Although the liquid detergent softener composition of the present invention is a stable, clear one-phase liquid, a compatible opacifying agent may be added to impart a creamy appearance to the formulation.

Still another optional but highly preferred ingredient in the present detergent compositions is an ethoxylated fatty amine, such as the Ethomeen® series of compounds of Armak Company, and the Varonic® series from Ashland Chemicals. These compounds can be represented by the general formula

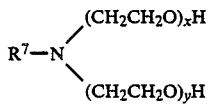

where $R^7$ is a fatty alkyl group of from about 10 to 22, preferably 12 to 18, carbon atoms and the sum of x+y is from about 2 to about 15. The $R^7$ group may be saturated or unsaturated, and, for example, may be derived from coco fatty acid, oleic acid, soya fatty acid, tallow fatty acid, stearic acid, or mixtures of these acids.

The ethoxylated amines contribute to improve cleaning, softening and static control. Usually amounts of the ethoxylated amine up to about 15%, preferably up to about 10%, for example 1-10%, or 1-8%, especially 2-8%, by weight of the total liquid composition are satisfactory.

To assist in solubilizing the detergents and optical brighteners which may be present in the liquid detergents a small proportion of alkaline material or a mixture of such materials is often included in the present formulations. Suitable alkaline materials include mono-, di- and trialkanolamines, alkyl amines, ammonium hydroxide and alkali metal hydroxides. Of these, the preferred materials are the alkanolamines, preferably the trialkanolamines and of these, especially triethanolamine. The pH of the final liquid detergent, containing such a basic material will usually be neutral or slightly basic. Satisfactory pH ranges are from 7 to 10, preferably about 7.5 to 9.5, but because a pH reading of the liquid detergent, using a glass electrode and a reference calomel electrode, may be inaccurate, due to the detergent system often being essentially non-aqueous, a better indication is obtained by measuring the pH of a 1% solution of the liquid detergent in water. Such a pH will also normally be in the range of about 7 to 10, preferably 7.5 to 9.5. In the wash water, the pH will usually be in this range or might be slightly more acidic, as by 0.5 to 1 pH unit, due to the organic acid content of soiled laundry. For the liquid formulations, the viscosity at 25° C. will be in the range of 40 to 1000 centipoises, preferably from 40 to 500 centipoises, according to measurements that are made with a Brookfield viscosimeter at room temperature, using a No. 1 spindle at 12 revolutions per minute.

The liquid composition is usually added to wash water in an automatic washing machine of either the top loading or front loading type so that the concentration thereof in the wash water may range from about 0.05 to 1.5%, usually 0.1 to 1.2%. Generally, depending on the type of machine and the degree of loading with the soiled fabrics, the amount of the liquid formulation to be added will range from about ¼ cup to about 1¼ cup, with the typical amount being about ½ cup (120 milliliters).

The wash water used may be a fairly soft water or water of reasonable hardness, and will generally and preferably be used at elevated temperature, especially at about 100° F. or higher, such as 120° F. to 180° F. or higher. The composition of the present invention is also useful in laundering clothes in very hard waters and at lower temperatures. Thus, water hardness may range from 0 to over 300 parts per million calculated as calcium carbonate, and washing temperatures may be from 40° to 120° F. or higher. Washing will be effected in an automatic washing machine in which the washing is followed by rinsing and spin or other draining or wringing cycles or operations. Of course, the detergent composition may also be used for hand washing of laundry, in which case it may sometimes be used full strength on certain stains on the laundry, or the laundry may be soaked in a higher concentration solution of detergent before washing.

The washing operations will generally take from three minutes to one hour, depending on the fabrics being washed and the degrees of soiling observed. After completion of washing and the spinning, draining or wringing operations, it is preferred to dry the laundry in an automatic dryer soon thereafter but line drying may also be employed.

The present detergent softener composition dissolves very easily whether the wash water is warm or cold, and very effectively cleans, softens and eliminates static charge on clothing and other items of laundry without imparting a water repellant finish thereto. It may be used in either top loading or front loading washing machines and may be desirably adjusted to foam to the correct extent. The product is an attractive clear, stable liquid which maintains its activity and uniformity over a long shelf life. In tests in which the effects of using it are compared to those from the employment of commercial liquid laundry detergents, it rated very favorably.

This product may be prepared by simply admixing the various ingredients at room temperature with agitation to ensure solubilization thereof in the aqueous medium. The order of addition of ingredients and the temperature of compounding may be varied without adversely affecting the formation of the single phase, clear liquid product of instant invention. More highly viscous formulations or pastes may be similarly prepared by customary techniques.

The detergent-softener composition of the present invention exhibits many desirable characteristics with regard to both physical properties and performance in use. As to its physical properties, the liquid compositions are pourable and free-flowing from the container as manufactured and after aging. They exhibit a high degree of stability upon storage at normal room temperature of the order of about 70° F. over a period of many months without any appreciable precipitation. As a result, the consumer can utilize them conventionally by addition of very small portions to a laundering bath, and the detergent and softener will be present in constant composition in each portion. While compatible adjuvant materials may be added to render the final product translucent or opaque as desired, the requirement for a one-phase solution of the main ingredients insures that effective washing and softening power will be obtained with each portion and promotes the stability and homogeneity of the product. The composition may be packaged in any suitable container or packaging material such as metal, plastic or glass.

The following specific examples illustrate various embodiments of the present invention. It is to be understood, however, that such examples are presented for purpose of illustration only, and the present invention is in no way to be deemed as limited thereby.

In order to test cleaning performance of the detergent compositions several different formulations were prepared and were used in standardized test procedures against a variety of soils and on different fabrics with different levels and proportions of active ingredients. All cleaning tests were carried out under the same conditions (unless otherwise noted) in the same model General Electric washing machines: 120° F., 100 ppm $Ca^{++}$, 17 gallons wash water, 0.2% product concentration (½ cup). Five combinations of soils and fabrics were used in the cleaning performance test: oily soil on cotton (from Test Fabrics Co.); oily soil on nylon (from Test Fabrics Co.); oily soil on cotton (from EMPA of France—purchased from Test France Co.); Piscataway clay (PC) on cotton; Piscataway clay on polyester (Dacron)/cotton (65/35) blend. Cleaning performance is measured by reflectance readings (Rd) as a measure of whiteness and these readings are correlated to provide a total soil removal value (SR) wherein the Rd values for the different soiled fabrics are each multiplied by a coefficient, which has been determined for each artifically soiled fabric to reflect the correlation between cleaning performance on the artifically soiled fabrics with practical laundry detergent tests. By comparing the SR values of any two compositions the relative overall cleaning performance (SRI) of the two compositions can be evaluated.

EXAMPLE 1

The following compositions were prepared:

TABLE 1

| | 1 | 2 | 3 | 4 | 5 | 6 | 7 | 8 | 9 | 10 | 11 | 12 |
|---|---|---|---|---|---|---|---|---|---|---|---|---|
| Neodol 25-7[1] | 21 | 21 | 21 | 21 | 29 | 21 | 21 | 21 | 21 | 21 | 21 | 21 |
| Arquad T-50[2] | — | 4 | — | 4 | — | — | 8 | 5 | 3 | 2 | — | 2 |
| Monawet SNO-35 | — | — | 4 | 4 | — | 8 | — | 3 | 5 | 2 | — | 6 |
| Water | | | | | | Balance | | | | | | |
| Ratio Quat/SNO | — | — | — | 1:1 | — | — | — | 1.7:1 | 1:1.7 | 1:1 | — | 1:3 |
| SRI vs. Run No. 1 | — | −19.1 | +8.5 | +14.4 | +1.8 | +8.8 | −13.1 | −8.9 | +16.6 | +9.9 | +3.3 | +8.4 |
| SRI vs. Run No. 11 | −3.2 | −22.3 | 5.3 | 11.2 | −1.5 | 5.5 | −16.3 | −12.2 | 13.3 | 6.7 | — | 5.2 |
| SR (total) | 204.8 | 185.7 | 213.3 | 219.2 | 206.5 | 213.5 | 191.7 | 195.8 | 221.3 | 214.7 | 208.0 | 213.2 |

Ingredient
Neodol 25-7[1]Nonionic Surfactant: $C_{12}$–$C_{15}$ primary fatty alcohol with 7 moles ethylene oxide (7EO) from Shell Oil Products
Arquad T-50[2]Quaternary Ammonium: Tallow trimethyl ammonium chloride, from Armak
Monawet SNO[3]tetrasodium N—(1,2-dicarboxyethyl)N—octadecyl sulfosuccinamate, from Mono Industries, Inc.

With regard to the above table, it should be noted that Run No. 11 is a repeat of Run No. 1 using a freshly prepared sample composition.

From the results reported in Table 1, the following observations and conclusions can be drawn:

The addition of quaternary compound alone (Run Nos. 2 and 7) to the nonionic (Run No. 1) has a very substantial negative effect on cleaning performance.

The addition of the succinamate surfactant alone (Run Nos. 3 and 6) improves cleaning performance significantly but, of course, imparts no softening benefit contributed by the quaternary compound.

The addition of quaternary compound and succinamate at a ratio of 1.7:1 (Run No. 8) shows substantial improvement over quaternary alone (Run Nos. 2 and 7) but still is substantially inferior to the control (Run No. 1).

At a total addition of quaternary and succinamate of 8 weight percent a ratio of quaternary/succinamate of 1:1.7 (Run 9) provides the best cleaning performance and is slightly better than a 1:1 ratio (Run 4) while a ratio of 1:3 (Run 12) provide about the same cleaning performance as succinamate alone (Run Nos. 3 and 6) at both 4% and 8% levels. In fact, the 1:3 ratio at the 8 weight% level (Run No. 12) is inferior to the 1:1 ratio (Run 10) at the 4% total weight level.

Therefore, under the conditions of this test, the preferred ratios of quaternary compound to succinamate are in the range of from about 1:1 to about 1:2, with ratios of from about above 1:2 to 1:3 still providing improvements in cleaning performance (e.g. whitening) as well as improved softening/anti-static performance.

EXAMPLE 2

Run Nos. 1–12 of Example 1 are each repeated but with the addition of an anionic surfactant: linear dodecyl benzene sulfonate (Na salt) (LDBS), in the amounts shown in Table 1. The results are also shown in Table 2. For ease of comparison, the values of SR (total) and SRI vs. Run No. 1 from Example 1 are also shown in Table 2.

TABLE 2

| | | | SR (total) | | SRI vs. Run 1 | |
|---|---|---|---|---|---|---|
| Run No. | Wt % LDBS | Wt % SNO | With LDBS | Without LDBS | With LDBS | Without LDBS |
| 1 | 4 | — | 207.3 | 204.8 | — | — |
| 2 | 4[1] | — | 213.3 | 185.7 | +6.0 | −19.1 |
| 3 | 4 | 4 | 212.8 | 213.3 | +5.5 | +8.5 |
| 4 | 4[1] | 4 | 219.2 | 219.2 | +11.9 | +14.4 |
| 5 (29% nonionic) | 8 | — | 211.4 | 206.5 | +4.2 | +1.8 |
| 6 | 8 | 8 | 214.4 | 213.4 | +7.1 | +8.8 |
| 7 | 8[1] | — | 208.7 | 191.7 | +1.3 | −13.1 |
| 8 | 5[1] | 3 | 220.5 | 195.8 | +13.1 | −8.9 |
| 9 | 3[1] | 5 | 218.7 | 221.3 | +11.4 | +16.6 |
| 10 | 2[1] | 2 | 218.2 | 214.7 | +10.9 | +9.9 |
| 11 | 4 | — | 210.7 | 208.0 | +3.4 | +3.2 |
| 12 | 2[1] | 6 | 218.1 | 213.2 | +10.8 | +8.4 |

[1]Quaternary/LDBS weight ratio 1:1

The following observations and conclusions can be drawn from the results reported in Table 2.

Run No. 2 and Run No. 7 correspond to the compositions which are the subject matter of application Ser. No. 661,775, i.e. mixtures of nonionic surfactant with 1:1 mixtures of cationic fabric softener and anionic surfactant (without sulfosuccinamate).

Run Nos. 3, 4, 6, 8, 9, 10 and 12 are according to this invention. As can be seen, over the range of quaternary/succinamate ratios of from 1.7:1 (Run No. 8) to 1:3 (Run No. 12) significantly better cleaning performance is obtained as compared to either quaternary alone (Run Nos. 2 and 7) or succinamate alone (Run Nos. 3 and 6).

Furthermore, the presence of the anionic surfactant in these formulations adds the additional benefit of enhancing the anti-static and softening performance of the mono-higher alkyl quaternary ammonium compound and, in the preferred compositions containing an optical brightener, the anionic will also function to deposit the brightener more effectively. At the same time, it is also clear that in certain formulations, the combination of the succinamate surfactant with the anionic surfactant significantly boosts overall cleaning performance, e.g. compare SR Total for Run No. 8 of Example 2 with Run No. 8 of Example 1).

In Examples 1 and 2, it should be noted that at the ½ cup usage level 21% and 29% Neodol 25-7 correspond to 25 grams per wash and 35 grams per wash, respectively; 4% and 8% of Arquad T-50 correspond to 5 g/wash and 10 g/wash, respectively; 4% and 8% Monawet SNO correspond to 5 g/wash and 10 g/wash, respectively.

EXAMPLE 3

If Example 1 or Example 2 is repeated using an equal amount of Neodol 23-6.5 ($RO(C_2H_4O)_{6.5}H$ wherein R=mixed 12 and 13 carbon atoms primary alcohol) or Tergitol 15-S-7 or Tergitol 15-S-9 (both of which are linear secondary alcohol ($C_{11}$–$C_{15}$) ethoxylates, trademarked products of Union Carbide Corp., the former with 7 moles ethylene oxide and the latter with 9 moles ethylene oxide) or with any one of nonylphenol condensed with 5, 7 or 9 moles ethylene oxide, isooctyl phenol condensed with 9, 10, 11 or 12 moles ethylene oxide, etc., in place of the Neodol 25-7, similar results will be obtained.

If in Example 1 or Example 2 the Monawet SNO-35 is replaced by an equal amount of Astromid 18, Astromid 22, Alkasurf SS-OA or Alkasurf SS-TA, similar results will be obtained.

Similarly, in Examples 1 and 2, similar results can be obtained using hydrogenated tallow trimethyl ammonium chloride
stearyl trimethyl ammonium chloride
stearyl triethyl ammonium chloride
stearyl dimethylethyl ammonium chloride
tallow diisopropylmethyl ammonium chloride and the corresponding sulfate, methosulfate, ethosulfate, bromide, and hydroxide salts, in place of the Arquad T-50. Arquad T-50 may also be replaced in whole or part with, for example, Ethoquad 18/12, or other similar ethoxylated mono-higher alkyl quat.

In Example 2, in place of the linear dodecylbenzene sulfonate anionic surfactant, generally similar results are achieved using, for example, Neodol 25-3S (from Shell Oil Products, formula $RO(C_2H_4O)_3SO_3Na$, R=mixed $C_{12}$ to $C_{15}$ primary fatty alcohol). The LDBS anionic surfactant may also be replaced in whole or in part, by, for example, sodium alpha-olefin sulfonate of 14 to 18 carbon atoms or sodium paraffin sulfonate of 13 to 17 carbon atoms, or the corresponding potassium salts of any of these.

EXAMPLE 4

The following compositions (shown in Table 3) were tested in the same manner as in Example 1, with the results (SR total) also being shown in Table 3.

TABLE 3

| | RUN NO. | | | | | | | |
|---|---|---|---|---|---|---|---|---|
| Ingredient | 1 | 2 | 3 | 4 | 5 | 6 | 7 | 8 |
| Neodol 25-7 | 21 | 21 | 21 | 21 | 21 | 21 | 21 | 21 |
| Triethanolamine | 1.7 | 1.7 | 1.7 | 1.7 | 1.7 | — | — | — |
| Tinopal UNPA | 0.5 | 0.5 | 0.5 | 0.5 | 0.5 | 0.5 | 0.5 | 0.5 |
| Adogen 471[1] | 4 | 4 | 4 | 4 | 4 | 4 | 4 | 4 |
| LDBS, Na salt | — | — | — | 4 | 4 | — | — | — |
| Neodol 25-3S | — | — | — | — | — | 4 | 4 | 4 |
| Sodium citrate | 4 | 4 | 4 | 4 | 4 | 4 | 4 | 4 |
| Methocel | — | — | — | — | 0.8 | — | — | — |
| Monawet SNO-35 | 4 | — | — | — | 4 | 4 | — | — |
| Astromid 22 | — | — | 4 | — | — | — | — | 4 |
| Astromid 18 | — | 4 | — | 4 | — | — | 4 | — |
| Water | qs 100 | qs 100 | qs 100 | qs 100 | qs 100 | qs 100 | qs 100 | qs 100 |

TABLE 3-continued

| Ingredient | RUN NO. 1 | 2 | 3 | 4 | 5 | 6 | 7 | 8 |
|---|---|---|---|---|---|---|---|---|
| SR Total | 240 | 238 | 237 | 225 | 227 | 236 | 230 | 234 |

[1]Tallow trimethyl ammonium chloride, from Sherex

EXAMPLE 5

In each of the compositions of Example 4, a portion of the Neodol 25-7 is replaced by Ethomeen T-25, an ethoxylated amine of formula

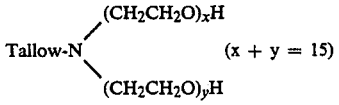

available from Armak, in an amount to provide from about 3 to 8% of the ethoxylated amine and correspondingly from about 18 to 13% of the nonionic surfactant. Improvements in cleaning, softening and static control can be observed. Formulations containing 15 weight% nonionic and 6 weight% of the ethoxylated amine provide especially good results.

EXAMPLE 6

In each of the compositions of Examples 4 and 5, the incorporation of an enzyme, or mixture of enzymes, in an amount up to about 2%, especially about 0.5–1%, by weight of the composition, improves cleaning performance against certain soils, for example, protease against protein deposits, amylase against starch deposits, etc. The enzymes are stable in the compositions and mixtures of different enzymes can be used.

EXAMPLE 7

Highly stable homogeneous, clear, aqueous compositions of comparable cleaning performance are prepared from the following ingredients:

| | A | B |
|---|---|---|
| Neodol 25-7 | 21 | 16 |
| Neodol 25-3S | 4 | — |
| Sodium dodecyl benzene sulfonate | — | 4 |
| Monawet SNO-35 | 4 | 3 |
| Arquad T-50 | 4 | 3 |
| Na citrate | 4 | — |
| Sodium xylene sulfonate | 4 | 3 |
| Optical Brightener | 0.5 | 0.5 |
| Enzyme | 0.5 | 0.5 |
| Water | qs 100 | qs 100 |

EXAMPLE 8

This example demonstrates the effect of the washing temperature on cleaning performance and also shows that the combination of cationic quaternary compound and succinamate detergent compound in the preferred proportions is effective at both low and high temperatures. In the same manner as described in Example 1, the following liquid compositions shown in Table 4 were prepared and evaluated under the conditions described in Example 1 at a wash water temperature of 120° F. or 70° F. The results (SRI values with nonionic alone (21%-Run No. 1) as control) are shown in Table 4:

TABLE 4

| | 1 | 2 | 3 | 4 | 5 | 6 | 7 | 8 |
|---|---|---|---|---|---|---|---|---|
| Neodol 25-7 | 21 | 21 | 21 | 21 | 21 | 21 | 21 | 21 |
| Neodol 25-3S | — | 4 | 4 | 4 | 4 | 4 | 4 | 4 |
| Adogen 471 | — | — | 4 | 4 | 4 | — | 4 | 4 |
| Monawet-SNO-35 | — | — | — | 4 | 4 | 4 | 8 | — |
| Sodium Citrate | — | — | — | — | 4 | 4 | — | 8 |
| Water | | | | Balance | | | | |
| SRI vs. Run 1 120° F. | — | +4 | +3 | +14 | +13 | +9 | +10 | +7 |
| SRI vs. Run 1 70° F. | — | +1 | −4 | +10 | +10 | +5 | 0 | +4 |

What I claim is:

1. An aqueous liquid detergent composition for cleaning and softening soiled fabrics and which can be added to the wash cycle of an automatic laundry machine, said composition comprising:

(A) from about 10 to 50% by weight of a liquid nonionic detergent selected from the group consisting of compounds of formulae (I) and (II):

$$RO(CH_2CH_2O)_nH \quad (I)$$

wherein R is a primary or secondary alkyl chain of from about 8 to 22 carbon atoms and n is an average of from about 5 to 20;

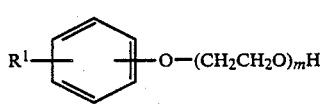

(II)

wherein $R^1$ is a primary or secondary alkyl chain of from 4 to 12 carbon atoms and m is an average of from about 5 to 20;

(B) fron about 1 to 20% by weight of a mono-higher alkyl quaternary ammonium compound of formulae (III) or (IV):

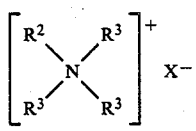

(III)

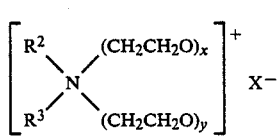

(IV)

wherein $R^2$ is a long chain aliphatic radical of from about 10 to 22 carbon atoms, each of the $R^3$'s in formula (III) and $R^3$ in formula (IV) are independently lower alkyl or hydroxy(-lower alkyl), X is a water-soluble salt forming anion, and x and y are each positive numbers of at least 1 and the sum x+y is from 2 to 15;

(C) from about 1 to 20% by weight of a sulfosuccinamate detergent compound of the formula

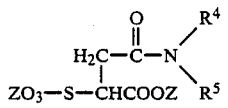

(V)

wherein Z is a monovalent salt-forming cation, $R^4$ is hydrogen, lower alkyl, carboxy(lower alkyl) or 1,2-dicarboxy(lower alkyl), and $R^5$ is an open chain hydrocarbon of from 10 to 22 carbon atoms;

(D) up to about 10% by weight of an anionic surfactant selected from the group consisting of linear higher alkyl aromatic sulfonates, poly-lower alkoxy higher alkanol sulfates, olefin sulfonates and paraffin sulfonates;

(E) up to about 3% of an optical brightener;

(F) up to about 15% of an ethoxylated amine;

(G) up to about 5% of an alkaline substance;

(H) up to about 3% of enzymes;

(I) up to about 3% of soil release agent; and (J) aqueous solvent carrier;

wherein the ratio of (B):(C) is in the range from about 3:1 to about 1:3.

2. The detergent composition of claim 1 wherein in formula (V) Z is an alkali metal, ammonium or amine, $R^4$ is hydrogen, methyl, ethyl, carboxymethyl, carboxyethyl, 1,2-dicarboxymethyl or 1,2-dicarboxyethyl, and $R^5$ is a saturated or unsaturated, straight or branched chain alkyl or alkenyl group of from about 14 to 18 carbon atoms.

3. The detergent composition of claim 1 wherein the sulfosuccinamate detergent compound is disodium N-octadecyl sulfosuccinamate, disodium N-oleyl sulfosuccinamate, or tetrasodium N-(1,2-dicarboxyethyl)N-octadecyl sulfosuccinamate.

4. The detergent composition of claim 1 which comprises from about 12 to 35% nonionic surfactant, from about 2 to 16% monoalkyl quaternary compound, and from about 2 to 16% of the sulfosuccinamate compound.

5. The detergent composition of claim 1 wherein the weight ratio of nonionic surfactant to monoalkyl quaternary is in the range of from about 15:1 to 2:1.

6. The composition of claim 1 wherein the anionic detergent (D) is present at a ratio of (C):(D) of from about 1.3:1 to about 1:1.5.

7. The composition of claim 1 which comprises (A) from about 12 to 35%, (B) from about 2 to 16%, (C) from about 2 to 16%, (D) in an amount to provide a ratio of (C):(D) of from about 1.2:1 to 1:1.2, (E) 0.2 to 2% by weight, (F) up to about 10%, (G) up to about 3%, (H) up to about 2%, (I) up to about 2%, and (J) balance.

8. The composition of claim 7 wherein (A) is a compound of formula (I) wherein R is a $C_{12}$ to $C_{15}$ alkyl or mixture thereof and n is a number of from about 6 to 13;

(B) is tallowtrimethyl ammonium chloride;

(C) is disodium N-octadecyl sulfosuccinamate, disodium N-oleyl sulfosuccinamate, or tetrasodium N-(1,2-dicarboxyethyl) N-octadecyl sulfosuccinate, and (D) is linear dodecylbenzene sulfonate or triethenoxy ($C_{12}$–$C_{15}$) alkanol sulfate.

9. The composition of claim 1 which comprises (A) from about 15 to 25% of a compound of formula (I) wherein R is a $C_{10}$ to $C_{18}$ primary or secondary alkyl and n is from about 6 to 13;

(B) from about 2 to 16% of a compound of formula (III) wherein $R^2$ is an aliphatic radical of from 12 to 18 carbon atoms and each $R^3$ is methyl;

(C) from about 2 to 16% of the sulfosuccinamate compound of formula (V) wherein $R^5$ has from about 14 to 18 carbon atoms and $R^4$ is hydrogen or 1,2-dicarboxyethyl, and an aqueous liquid carrier.

10. The composition of claim 9 wherein the ratio of (B):(C) is in the range of from about 1:1 to about 1:2.

11. The composition of claim 9 which further comprises (D) a linear higher alkyl benzene sulfonate or polyethoxy higher alkanol sulfate in an amount to provide a ratio of (C):(D) of from about 1.1:1 to about 1:1.1.

12. The composition of claim 11 wherein the ratio of (B):(C) is in the range of from about 1.5:1 to about 3:1.

13. A method for cleaning and softening soiled fabrics which comprises contacting the soiled fabrics in an aqueous wash bath in the presence of the detergent composition of claim 1.

14. The method of claim 13 wherein the contact is carried out in an automatic washing machine having a wash cycle and a water rinse cycle and wherein the detergent composition is added during the wash cycle.

15. The method of claim 14 wherein the temperature of the aqueous wash bath at least during the wash cycle is at least about 50° F.

* * * * *